US009149162B2

(12) United States Patent
Dick et al.

(10) Patent No.: US 9,149,162 B2
(45) Date of Patent: Oct. 6, 2015

(54) UNIVERSAL DISPENSER FOR ROLLED SHEET PRODUCT

(75) Inventors: Tamara Dick, Fox Lake, IL (US); Kenneth S. Chua, Glenview, IL (US); John Henry Kutsch, Harvard, IL (US); Vince R. Lackowski, Glenview, IL (US)

(73) Assignee: Medline Industries, Inc., Mundelein, IL (US)

( * ) Notice: Subject to any disclaimer, the term of this patent is extended or adjusted under 35 U.S.C. 154(b) by 331 days.

(21) Appl. No.: 13/018,784

(22) Filed: Feb. 1, 2011

(65) Prior Publication Data

US 2012/0193387 A1 Aug. 2, 2012

(51) Int. Cl.
*B26F 3/02* (2006.01)
*A47K 10/36* (2006.01)

(52) U.S. Cl.
CPC ..... *A47K 10/3606* (2013.01); *Y10T 225/22* (2015.04)

(58) Field of Classification Search
CPC ..... A47K 10/3836; A47K 10/3606; A47K 10/025; A47K 10/06; A47K 10/08; A47K 10/10; A47K 10/22; A47K 10/36; A47K 10/34; A47K 10/3618; A47K 10/3612; B21C 47/20; B21C 47/16; B21C 47/18; B65H 19/123; B65H 19/12; B65H 19/00; Y10T 225/22
USPC ..... 225/10–15, 23; 221/30, 61, 62, 95, 100; 242/565, 550, 598.5, 598.2, 597; 312/329; 248/905; 211/7, 6, 105.1, 211/59.1, 57.1, 54.1, 44, 88.04, 16, 123; D6/523
See application file for complete search history.

(56) References Cited

U.S. PATENT DOCUMENTS

| | | | | | |
|---|---|---|---|---|---|
| 2,576,526 | A | * | 11/1951 | Marchand | 242/598.5 |
| 3,061,217 | A | * | 10/1962 | Grant | 242/597.5 |
| 3,381,916 | A | * | 5/1968 | Edgell | 242/381.2 |
| 3,475,067 | A | * | 10/1969 | Girard | 312/34.22 |
| 3,730,409 | A | * | 5/1973 | Ratti | 225/14 |

(Continued)

FOREIGN PATENT DOCUMENTS

JP 2005/245647 9/2005

OTHER PUBLICATIONS

"Korean Search Report", PCT/US2012/023091; Filed Jan. 30, 2012; Mailed Aug. 29, 2012.

(Continued)

*Primary Examiner* — Sean Michalski
*Assistant Examiner* — Jonathan G Riley
(74) *Attorney, Agent, or Firm* — Philip H. Burrus, IV

(57) ABSTRACT

A rolled sheet dispenser (100) includes a first housing member (601) that is hingedly coupled to a second housing member (602). A pair of feed rollers (501,502) are disposed within the rolled sheet dispenser (100), with one of the feed rollers (501) disposed within the first housing member (601) and the other feed roller (502) disposed within the second housing member (602). A mounting stem (503), which is capable of accommodating both cored and coreless paper rolls of different widths, is disposed within one of the housings. When the first housing member (601) is pivoted to a closed position, the feed rollers (501,502) abut. When the first housing member (601) and the second housing member (602) are pivoted to an open position, the feed rollers (501,502) separate. Also, an end (608) of the mounting stem (503) becomes exposed and accessible.

19 Claims, 5 Drawing Sheets

(56) References Cited

U.S. PATENT DOCUMENTS

| | | | | | |
|---|---|---|---|---|---|
| 3,792,807 | A | * | 2/1974 | Mare et al. | 225/100 |
| 3,896,691 | A | * | 7/1975 | Granger et al. | 83/335 |
| 4,067,509 | A | | 1/1978 | Graham et al. | |
| D254,412 | S | * | 3/1980 | Knight | D6/523 |
| 4,611,768 | A | * | 9/1986 | Voss et al. | 242/564.2 |
| 5,065,924 | A | * | 11/1991 | Granger | 225/46 |
| 5,312,021 | A | * | 5/1994 | Nelson | 222/183 |
| 5,979,284 | A | * | 11/1999 | Granger | 83/649 |
| 6,036,134 | A | * | 3/2000 | Moody | 242/422.4 |
| 6,161,795 | A | * | 12/2000 | Skerrett et al. | 242/564.5 |
| 6,202,956 | B1 | * | 3/2001 | Grasso et al. | 242/560 |
| 6,296,331 | B1 | * | 10/2001 | Tramontina | 312/34.1 |
| 7,793,882 | B2 | * | 9/2010 | Reinsel et al. | 242/563 |
| 2003/0160379 | A1 | | 8/2003 | Shimamura | |
| 2004/0050993 | A1 | | 3/2004 | Green | |
| 2004/0251293 | A1 | | 12/2004 | Toshiharu | |
| 2008/0245922 | A1 | * | 10/2008 | Fellhoelter | 242/554.6 |
| 2009/0065628 | A1 | | 3/2009 | Troutman et al. | |
| 2009/0159735 | A1 | * | 6/2009 | Cattacin et al. | 242/416 |
| 2012/0091249 | A1 | * | 4/2012 | Crossett et al. | 242/580 |

OTHER PUBLICATIONS

"Catalog", Medline Product Catalog; Etchless Roll Towel Dispensers by Kimberly-Clark; http://www.medline.com/catalog/catalog.jsp; Unknown Publication Date but believed to be prior to filing of present application.

"Catalog", Medline Product Catalog; enMotion Impluse 10 Automated Towel Dispenser; http://www.medline.com/catalog/catalog.jsp; Publication Date unknown but believed to be prior to filing of present application.

"Catalog", Medline Product Catalog; Enmotion Recessed Automated Towel Dispenser by Georgia Pacific; http://www.medline.com/catalog/catalog.jsp; Publication Date unknown but believed to be prior to filing of present application.

"Catalog", Medline Product Catalog; Georgia-Pacific C-Fold Towel Dispenser By Georgia Pacific; http://www.medline.com/catalog/catalog.jsp; Publication Date unknown but believed to be prior to filing of present application.

"Catalog", Medline Product Catalog; GP Chrome Multifold Space Saver Towel Dispenser; http://www.medline.com/catalog/catalog.jsp; Publication Date unknown but believed to be prior to filing of present application.

"Catalog", Medline Product Catalog; GP Combination C-Fold/Multifold Paper Towel Dispenser; http://www.medline.com/catalog/catalog.jsp; Publication Date unknown but believed to be prior to filing of present application.

"Catalog", Medline Product Catalog; GP Push Paddle Roll Paper Towel Dispenser; http://www.medline.com/catalog/catalog.jsp; Publication Date unknown but believed to be prior to filing of present application.

"Catalog", Medline Product Catalog; Hands-Free Paper Towel Dispenser; http://www.medline.com/catalog/catalog.jsp; Publication Date unknown but believed to be prior to filing of present application.

"Catalog", Medline Product Catalog; Hand-Free Roll Towel Dispensers by Kimberly; http://www.medline.com/catalog/catalog.jsp; Publication Date unknown but believed to be prior to filing of present application.

"Catalog", Medline Product Catalog; In-Sight Jrt Jumbo Roll Tissue Dispenser By Kimberly-Clark; http://www.medline.com/catalog/catalog.jsp; Publication Date unknown but believed to be prior to filing of present application.

"Catalog", Medline Product Catalog; In-Sight Roll Towel Dispensers by Kimberly-Clark; http://www.medline.com/catalog/catalog.jsp; Publication Date unknown but believed to be prior to filing of present application.

"Catalog", Medline Product Catalog; In-Sight Sanitouch Hard Roll Towel Dispenser by Kimberly-Clark; http://www.medline.com/catalog/catalog.jsp; Publication Date unknown but believed to be prior to filing of present application.

"Catalog", Medline Product Catalog; In-Sight Touchlesstowel Dispensers by Kimberly-Clark; http://www.medline.com/catalog/catalog.jsp; Publication Date unknown but believed to be prior to filing of present application.

"Catalog", Medline Product Catalog; Lev-R-Matic Roll Towel Dispensers by Kimberly-Clark; http://www.medline.com/catalog/catalog.jsp; Publication Date unknown but believed to be prior to filing of present application.

"Catalog", Medline Product Catalog; Roll Towel Lever Dispenser; http://www.medline.com/catalog/catalog.jsp; Publication Date unknown but believed to be prior to filing of present application.

"Catalog", Medline Product Catalog; Sanitouch Hard Roll Towel Dispensers by Kimberly-Clark; http://www.medline.com/catalog/catalog.jsp; Publication Date unknown but believed to be prior to filing of present application.

"Catalog", Medline Product Catalog; Scottfold Compact Towel Dispensers by Kimberly Clark; http://www.medline.com/catalog/catalog.jsp; Publication Date unknown but believed to be prior to filing of present application.

"Catalog", Medline Product Catalog; SofPull Paper Towel Dispensers by Georgia Pacific; http://www.medline.com/catalog/catalog.jsp; Publication Date unknown but believed to be prior to filing of present application.

"Catalog", Medline Product Catalog; Touchless Roll Towel Dispensers by Kimberly-Clark; http://www.medline.com/catalog/catalog.jsp; Publication Date unknown but believed to be prior to filing of present application.

"Catalog", Medline Product Catalog; Towel Dispenser by TIDI; http://www.medline.com/catalog/catalog.jsp; Publication Date unknown but believed to be prior to filing of present application.

"Catalog", Medline Product Catalog; Universal Folded Towel Dispensers by Kimberly Clark; http://www.medline.com/catalog/catalog.jsp; Publication Date unknown but believed to be prior to filing of present application.

* cited by examiner

UNIVERSAL DISPENSER FOR ROLLED SHEET PRODUCT

BACKGROUND

1. Technical Field

This invention relates generally to a rolled sheet dispenser, and more particularly to a dispenser configured to dispense a variety of types and sizes of rolled material.

2. Background Art

Paper towel dispensers are ubiquitous items in public restrooms. There are many different types and styles. Some are automatic and some are manually operated. Automatic styles of dispensers generally include a housing, a roll mount, and a feeding mechanism configured to dispense paper. The feeding mechanism may include a motor, a fixed guide, and/or fixedly mounted rollers for moving the towel material along a path from the roll to an exterior part of the housing.

Prior art dispensers are generally configured to accommodate only a certain type of roll. Additionally, prior art dispenser can be difficult to load. It would be advantageous to have a dispenser configured to dispense various types of rolled material without these limitations.

Figure 1:
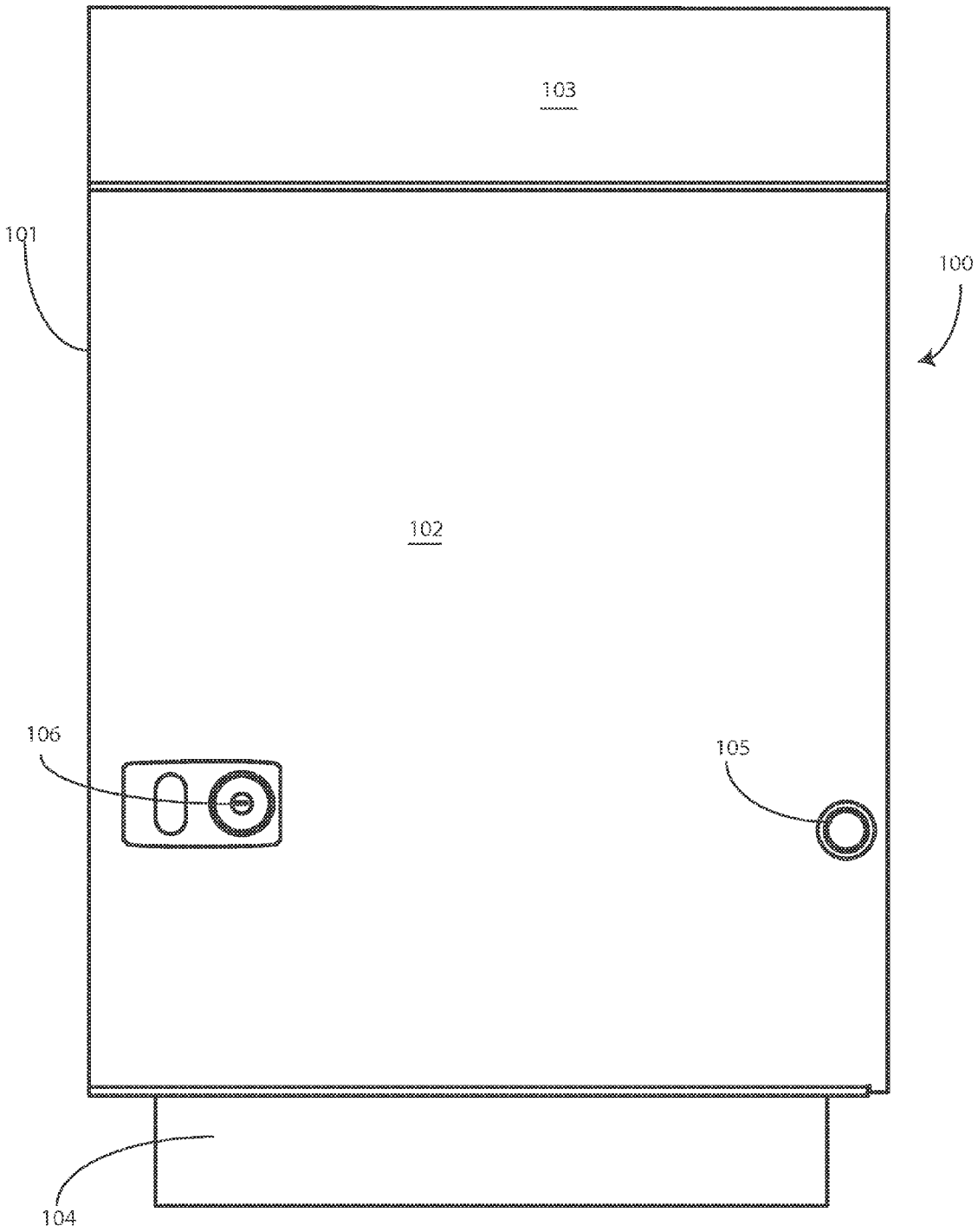
FIG. 1 illustrates a front elevation view of one dispenser configured in accordance with embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

Additionally, for simplicity of discussion and brevity of application, one illustrative embodiment of a dispenser has been set forth in FIGS. 1-7. However, it is not intended for FIGS. 1-7 to describe a single embodiment. The description below will highlight various alterations and substitutions that can be incorporated or added to form additional embodiments. Further, dispensers having features described herein can be constructed from a number of materials and in a number of shapes. Other embodiments will also be readily apparent to those of ordinary skill in the art having the benefit of this disclosure. Accordingly, while one illustrative embodiment is shown in FIGS. 1-7, multiple embodiments are described and illustrated in this disclosure.

DETAILED DESCRIPTION OF EMBODIMENTS OF THE INVENTION

Before describing in detail embodiments that are in accordance with embodiments of the present invention, it should be observed that the embodiments reside primarily in various combinations of apparatus components related to dispensation of rolled materials. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. It is expected that one of ordinary skill, notwithstanding possibly significant effort and many design choices motivated by, for example, available time, current technology, and economic considerations, when guided by the concepts and principles disclosed herein will be readily capable of generating such apparatus components with minimal experimentation.

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions.

Prior art rolled product dispensers suffer from two limitations. The first relates to the roll mount. Many dispensers are configured for only one type of roll mount. The roll may be designed with a particular width or thickness. Further, the roll may have a "core," such as a cardboard tube, or it may only be a roll of the material, i.e., "coreless." Using a ten-inch, cored roll as an example, many dispensers have a roll mount that includes a right mount and a left mount. The right and left mounts are configured to precisely fit within the diameter of the core. Further, the right and left mount are generally configured to fit into the core by only an inch or so on either side so the core can be easily removed when a new roll is required. The problem with such a mount is that if a user wishes to use, for example, an eight-inch, coreless roll, they simply cannot.

The second limitation relates to the feeder. In most prior art dispensers, a user must "feed" a portion of a new roll either into a feeding guide or between to fixed rollers. Said differently, when changing the roll, an attendant must break or tear the rolled product, and then meticulously feed it into a mechanical feeding system. If the product is incorrectly fed, stoppages may occur. Further, if the attendant is not successful in "threading the needle" on the first try, product may be wasted.

Embodiments of the present invention overcome both of these limitations. Embodiments of the present invention provide a rolled product dispenser that is capable of using any of a variety of roll types. For instance, embodiments described herein are capable of dispensing ten-inch, cored rolls. They are also capable of dispensing ten-inch, coreless rolls. They are also capable of dispensing eight inch, cored rolls. Additionally, they are capable of dispensing eight inch, coreless rolls. Of course, dimensions and core constructions other than these illustrative examples can also be accommodated.

Additionally, with embodiments of the present invention, there is no need to meticulously feed a thin, pliable sheet of product into a feeding mechanism. In one embodiment, a dispenser configured in accordance with the present disclosure includes a first roller and a second roller that separate when a first housing member is opened about a hinge assembly from a second housing member. This "separation of rollers" permits an attendant to simply lay the rolled material across one of the exposed rollers and close the housing members. That's it! Time is saved and product is conserved.

In short, embodiments described herein provide a universal solution in a rolled product dispenser. Embodiments described below are well suited for dispensing paper products, such as paper towels, but can also be used to dispense other rolled product and materials. When configured as a paper towel dispenser, embodiments described below are capable of automatically dispensing paper towels without a feeding requirement when loading the roll. As will be illustrated and described in more detail below, embodiments of the present invention employ a pair of rollers that close directly on the product during the loading process. As noted above, this eliminates the need for an attendant to manually feed paper into the machine. Further, embodiments described herein are capable of using either coreless or cored roles due to the inclusion of a single-ended mounting stem. Rather than meticulously fitting a roll between right and left mounts, with embodiments of the present invention an attendant simply slides the roll along the single-ended mounting stem.

In one embodiment, a housing dispenser is configured to "split" in the middle. This separated housing design exposes the single-ended mounting stem when the housing is opened, thereby causing the open end of the mounting stem to conveniently and efficiently face the attendant. The split housing also causes the rollers to separate, thereby making the loading process simpler. Accordingly, with embodiments described below, it matters not how the roll is oriented during installation, as the dispenser works whether the roll is inserted left end first, right end first, upside down, etc. The design also represents a robustness of design and a simplification of parts and components providing, in one embodiment, a reliable, automatic, and touch-less rolled product dispenser that does require complex circuits or exotic parts. Embodiments described herein are easy to maintain and are resistant to abuse. Embodiments described herein include a simple parts list that is easy and economical to manufacture.

While the dispensation of paper towels will be used herein to illustrate operation of some of the apparatus components, it will be clear to those of ordinary skill in the art that embodiments of the invention are not so limited. They could also be used to dispense other rolled product, including toilet paper, wrapping paper, cellophane and other types of plastic wrap, fabric, material sheeting, and so forth.

Figure 2:
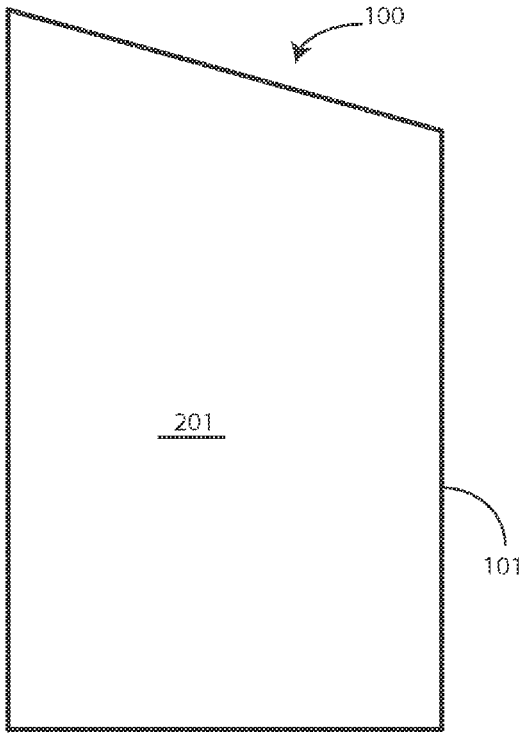
FIG. 2 illustrates a side elevation view of one dispenser configured in accordance with embodiments of the invention.
Figure 3:
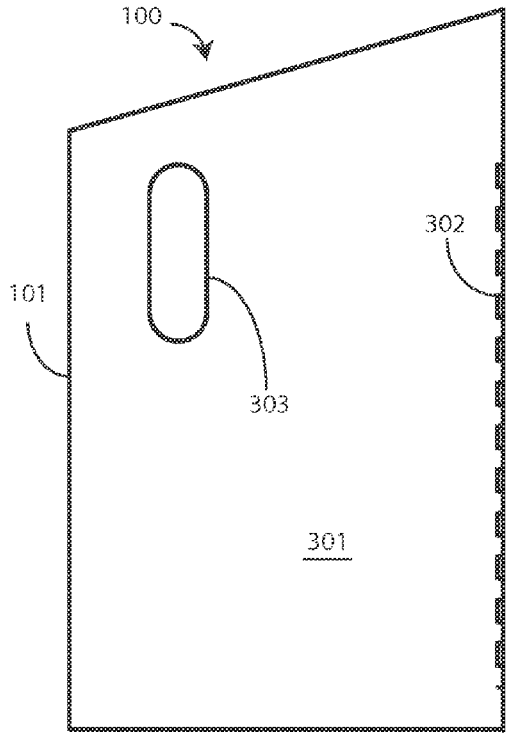
FIG. 3 illustrates another side elevation view of one dispenser configured in accordance with embodiments of the invention.
Figure 4:
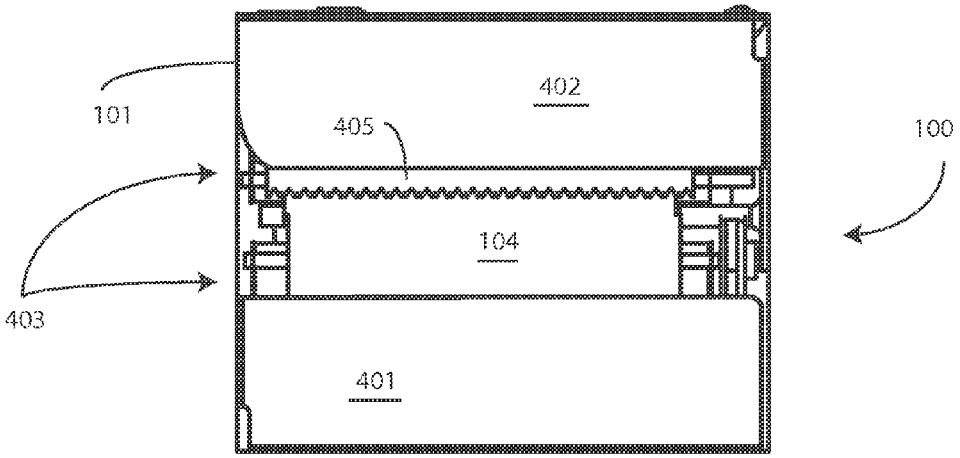
FIG. 4 illustrates a bottom plan view of one dispenser configured in accordance with embodiments of the invention.

Turning now to FIGS. 1-7 collectively, embodiments of the invention will be described with like reference numbers carried throughout the views. A rolled sheet dispenser 100 includes a housing 101. The housing 101 may be manufactured in a variety of shapes and from a variety of materials. For example, shown in FIG. 1, the illustrative rolled sheet dispenser 100 has a rectangular frontal profile. As shown in FIGS. 2 and 3, the illustrative rolled sheet dispenser 100 has a trapezoidal side profile. However, it will be clear to those of ordinary skill in the art having the benefit of this disclosure that embodiments described herein are not so limited. For example, the frontal profile could be round, oval, hexagonal, octagonal, and so forth. Similarly, the side profile could be round, square, rectangular, and so forth.

In one embodiment, the housing 101 is manufactured from metal. For example, in one embodiment the housing 101 is manufactured from stainless steel sheet metal. In another embodiment, the housing 101 is manufactured from painted sheet metal. In another embodiment, the housing 101 is manufactured from an enamel-coated metal. In another embodiment, the housing 101 is manufactured from opaque thermoplastic material, such as polycarbonate or ABS. In another embodiment, the housing 101 is manufactured from a translucent thermoplastic material. Other materials will be readily apparent to those of ordinary skill in the art having the benefit of this disclosure.

Figure 6:
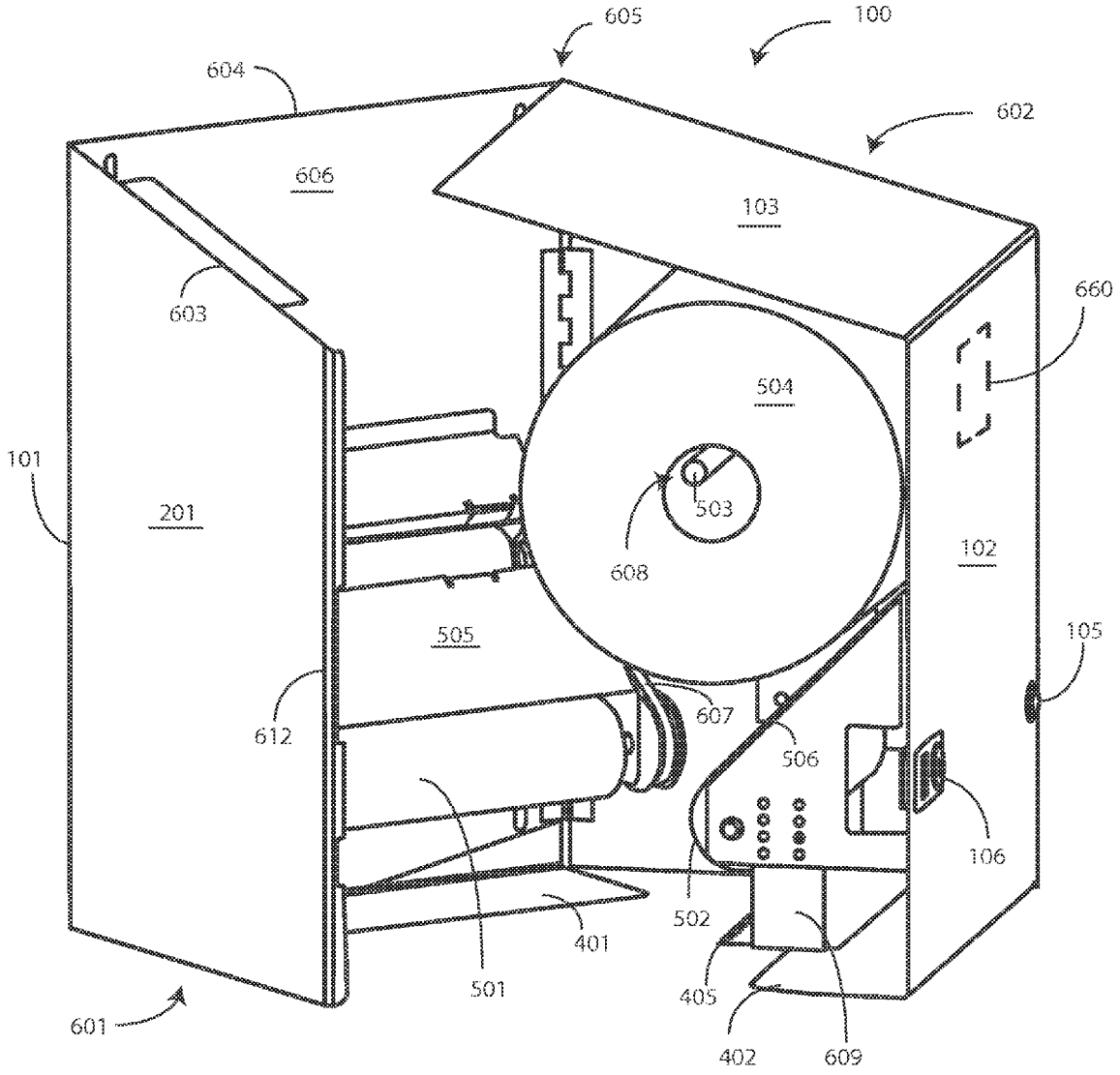
FIG. 6 is a perspective view of one dispenser with a first housing member rotated about a hinged to an at least partly open orientation relative to a second housing member in accordance with one or more embodiments of the invention.
Figure 7:
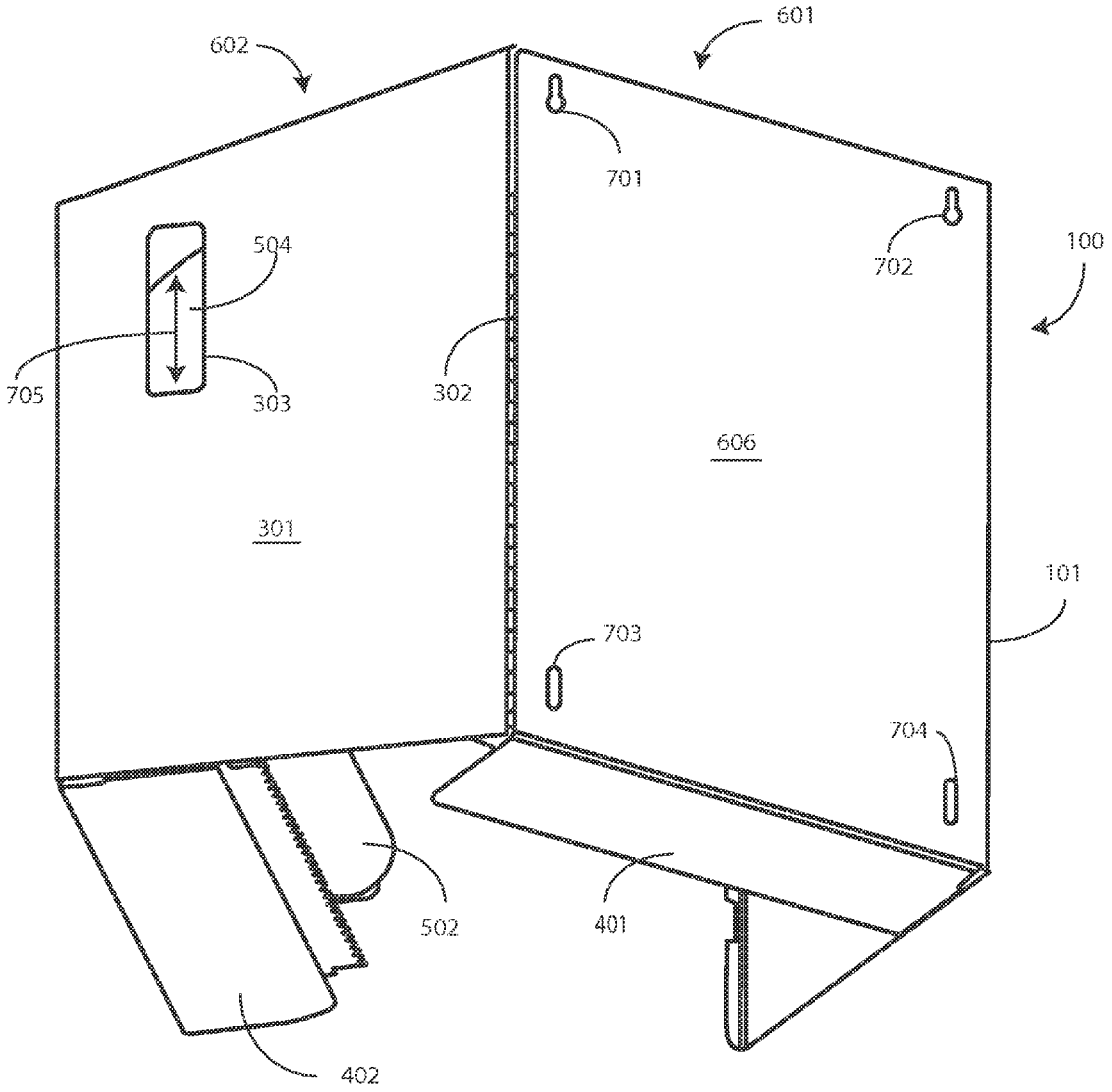
FIG. 7 is another perspective view of one dispenser with a first housing member rotated about a hinged to an at least partly open orientation relative to a second housing member in accordance with one or more embodiments of the invention.

In one embodiment, the housing 101 comprises a first housing member 601 and a second housing member 602. As shown in FIGS. 6 and 7, in one embodiment the parting line between the first housing member 601 and the second housing member passes along edges 612,603,604,605 of the first housing member 601 such that the housing 101 is substantially divided in half. In the illustrative embodiment shown in FIGS. 6 and 7, the second housing member 602 includes a dispenser top 103 that extends from a front face 102 of the second housing member 602. Note that the dispenser top 103 could also extend from an edge 604 of the first housing member 601, or could be split equally between the first housing member 601 and the second housing member 602, or could be split at other portions between the first housing member 601 and the second housing member 602. In the illustrative embodiment of FIGS. 6 and 7, with the exception of the dispenser top 103, the parting line divides the first housing member 601 and the second housing member 602 substantially equally such that the first housing member 601 forms a first half housing and the second housing member forms a second half housing.

In one embodiment, the first housing member 601 comprises a sidewall 201 and a mounting wall 606. The mounting wall 606, in one embodiment, includes one or more through-hole features 701,702,703,704 that are configured for mounting the rolled sheet dispenser 100 to a wall or other surface. Other mounting features could be substituted for the through-hole features 701,702,703,704, including hooks, loops, wires, and so forth.

In one embodiment the sidewall 201 extends distally from mounting wall 606 to form a substantially orthogonal angle. The term "substantially" is used herein to describe a measurement that is targeted to be a particular amount, but is not necessarily exactly that amount due to manufacturing tolerances. For example, a substantially orthogonal wall configuration may include two walls that are oriented 89.0234 degrees relative to each other, 92.321 degrees relative to each other, or another angle that is not exactly 90 degrees due to manufacturing tolerances. The term "about" is used herein to incorporate the same tolerance limitations.

In one embodiment, the second housing member 602 comprises a front wall 102 and another sidewall 201 extending distally from the front wall 102. In one embodiment, the front wall 102 and sidewall 201 are oriented substantially orthogonally relative to each other.

In the illustrative embodiment shown in the figures, each of the first housing member 601 and the second housing member 602 include a bottom wall 401,402 that extends from its respective housing member toward the other. The first housing member 601 includes a first bottom wall 410 that extends from the mounting wall 606 towards the second housing member 602, while the second housing member includes a second bottom wall 410 that extends from the front wall 102 towards the first housing member 601. In one embodiment, each bottom wall 401,402 extends toward the opposite housing member substantially orthogonally. In another embodiment, each bottom wall 401,402 extends at an obtuse angle from its respective housing member. In one embodiment, each bottom wall 401,402 stops short, i.e., it stops extending from its respective housing member, to define a paper dispensing opening 403 through which rolled product 104 is dispensed. The bottom walls 401,402 provide a safety feature in that they work to prevent users from coming in contact with the blade 405 of the cutting head 609.

In one embodiment, the first housing member 601 and the second housing member 602 are hingedly coupled together by a hinge assembly 302. In one embodiment, the hinge assembly 302 is arranged substantially parallel with an edge 605 of the mounting wall 606. In the illustrative embodiment shown in FIGS. 3, 6, and 7, the hinge assembly 302 is coupled to, and runs along, the edge 605 of the mounting wall 606 at a location between the mounting wall 606 and the sidewall 301 of the second housing member 602. Said differently, in the embodiment shown in FIGS. 3, 6, and 7, the hinge assembly 302 is disposed at the interface between the first housing member 601 and the second housing member 602, and, more particularly, at the interface between the mounting wall 6060 and the sidewall 301 of the second housing member 602. In one embodiment, the hinge assembly 302 is a single unit hinge device, although multiple hinges could also be used.

In one embodiment the first housing member 601 is configured to rotate about the hinge assembly 302 relative to the second housing member 602. Looking at the rolled sheet dispenser 100 in a mounted scenario, when the mounting wall 606 is fixedly coupled to a mounting surface, such as a wall, the second housing member 602 is configured to rotate about the hinge assembly 302 relative to the first housing member 601. In one embodiment, the first housing member 601 and second housing member 602 are configured to rotate relative to each other about the hinge assembly from a closed position, shown in FIGS. 1-4, to an open position, shown in FIGS. 6-7.

The feeding mechanism of the rolled sheet dispenser, in one embodiment, comprises a first feed roller 501 and a second feed roller 502. While the first feed roller 501 and the second feed roller 502 can take any of a number of forms, in one embodiment they have a diameter of about two and one-quarter inches. Their periphery is covered with a compressible friction surface, such as one made from a layer of soft rubber.

In one embodiment the first feed roller 501 is a drive roller and the second feed roller 502 is a pressure roller, in that it passively rolls when the first feed roller 501 is driven, but while placing pressure against the first feed roller 501. In another embodiment, the second feed roller 502 is the drive roller, while the first feed roller 501 is a pressure roller. In yet another embodiment, both the first feed roller 501 and the second feed roller 502 are drive rollers, such that the pressure roller formed by the second feed roller 502 is also a drive roller. In one embodiment, the first feed roller 501 is driven by a belt that is driven by a battery-operated motor. The operation of the drive action will be explained in more detail below.

In one embodiment the first feed roller 501 is fixedly coupled to the first housing member 601, while the second feed roller 502 is fixedly coupled to the second housing member 602. Of course, the opposite could be true. However, in one embodiment the rolled paper dispenser 100 is configured with one of the rollers is disposed in one housing and another roller in the other housing such that when the first housing member 601 is rotated away from the second housing member 602 about the hinge assembly 302, one of the rollers separates from another of rollers. Illustrating by example, if the drive roller is disposed in the first housing member 601 and the pressure roller is disposed in the second housing member 602, when the first housing member 601 is rotated away from the second housing member 602 about the hinge assembly 302, the pressure roller separates from the drive roller, thereby separating the feeding mechanism down the middle.

In one embodiment, a mounting stem 503 is disposed within the second housing member 602. In one embodiment, the mounting stem 503 fixedly coupled to the sidewall 201 of the second housing member 602 and is also arranged substantially parallel to the second feed roller 502. In one embodiment, the mounting stem 503 is positioned beneath the top 103. Where, as in FIGS. 5-7, the first feed roller 501 and the second feed roller 502 are parallel, the mounting stem 503 will also be parallel to the first feed roller 501.

In one embodiment, the mounting stem 503 comprises about a one-half inch diameter steel rod. Such a mounting stem 503 is well suited for use with embodiments of the invention in that both cored and coreless paper rolls having widths of between eight inches and twelve inches can easily be slid along the mounting stem 503. For example, a cored paper roll 504 has been placed on the mounting stem 503 in FIGS. 5 and 6. Note that the mounting stem can have other diameters, including those narrower than the one-half inch diameter. Additionally, the mounting stem 503 can be manufactured from other materials, including plastic.

In one embodiment, when the first housing member 601 is rotated about the hinge assembly 302 relative to the second housing member 602 from a closed position (FIGS. 1-4) to an open position (FIGS. 6-7), an end 608 of the mounting stem 503 becomes exposed to a user. This is most easily seen in FIG. 6. When the second housing member 602 is opened, the end 608 of the mounting stem 503 becomes exposed to the user. The exposure of the end 608 of the mounting stem 503 facilitates easy loading of a paper roll 504 in that it is simply slid onto the mounting stem. Meticulous alignment, such as that required in prior art, two-ended paper mounts, is not required.

In one embodiment, an optional lock 106 is provided to keep the first housing member 601 and the second housing member 602 closed. In the illustrative embodiment shown in the figures, the lock 106 is disposed substantially opposite the hinge assembly 302 and is used for selectively locking the first housing member 601 and the second housing member 602 together. The inclusion of the lock 106 prevents unauthorized personnel from removing the paper roll 504.

A cutter head 609 is provided with a cutting blade 405 attached thereto. In the illustrative embodiment shown in the figures, the cutter head 609 is mounted above the product dispensing opening 403, in a slightly off-center alignment. The off-center alignment permits rolled product 104 to pass substantially through the center of the product dispensing opening 403.

In one embodiment, the cutter head 609 is a pivoting cutter head and is coupled to a switch. When a user pulls the rolled product 104 against the cutter head 609 to cut the rolled product 104 with the blade 405, the cutter head 609 pivots slightly, thereby actuating the switch. The switch then actuates the motor 507 that is coupled to the drive roller. Accordingly, when a first sheet of rolled product 104 is torn, the drive roller is actuated to dispense another sheet of rolled product 104 through the product-dispensing opening 403. Using paper towels as an illustrative example, when a user tears one sheet with the blade 405, the cutter head 609 pivots to actuate the drive roller so that another sheet can be dispensed. It will be clear to those of ordinary skill in the art having the benefit of this disclosure that the drive roller can be configured to dispense a new sheet of varying lengths, depending upon application.

In one embodiment, the motor 507 driving the drive roller is controlled by circuitry that executes ladder logic when actuating the motor. For example, in one embodiment, the switch comprises a series or switches arranged such that when a user pulls rolled product 104 against the blade 405, the cutter head 609 pivots and triggers a first switch. The motor 507 then becomes energized, thereby causing the drive roller to make a predetermined number of revolutions until another switch, known as a "follower switch," causes the motor 507 to stop. In one embodiment, this action causes a predetermined length, such as about ten inches or so, of rolled product 104 to be dispensed for the next user.

The paragraphs above set forth an "automatic" dispensation where a pivoting cutter head 609 is used. However, other embodiments are possible as well. For example, in one embodiment the cutter head 609 can be fixed. A user can cause dispensation of rolled product 104 at the time of their choosing by actuating a push-button switch 105. In another embodiment, a manual dispensation lever or handle can be used. Of course, combinations of these can be used. For example, in one embodiment the rolled sheet dispenser 100 can be configured as an automatic dispenser, for example by using the pivoting cutter head 609 and switch described above, along with the push-button switch 105 serving as an auxiliary switch that overrides the switch toggled by the pivoting cutter head 609. This configuration allows a user to selectively dispense rolled product 104 if something goes wrong with the automatic feeding mechanism.

Figure 5:
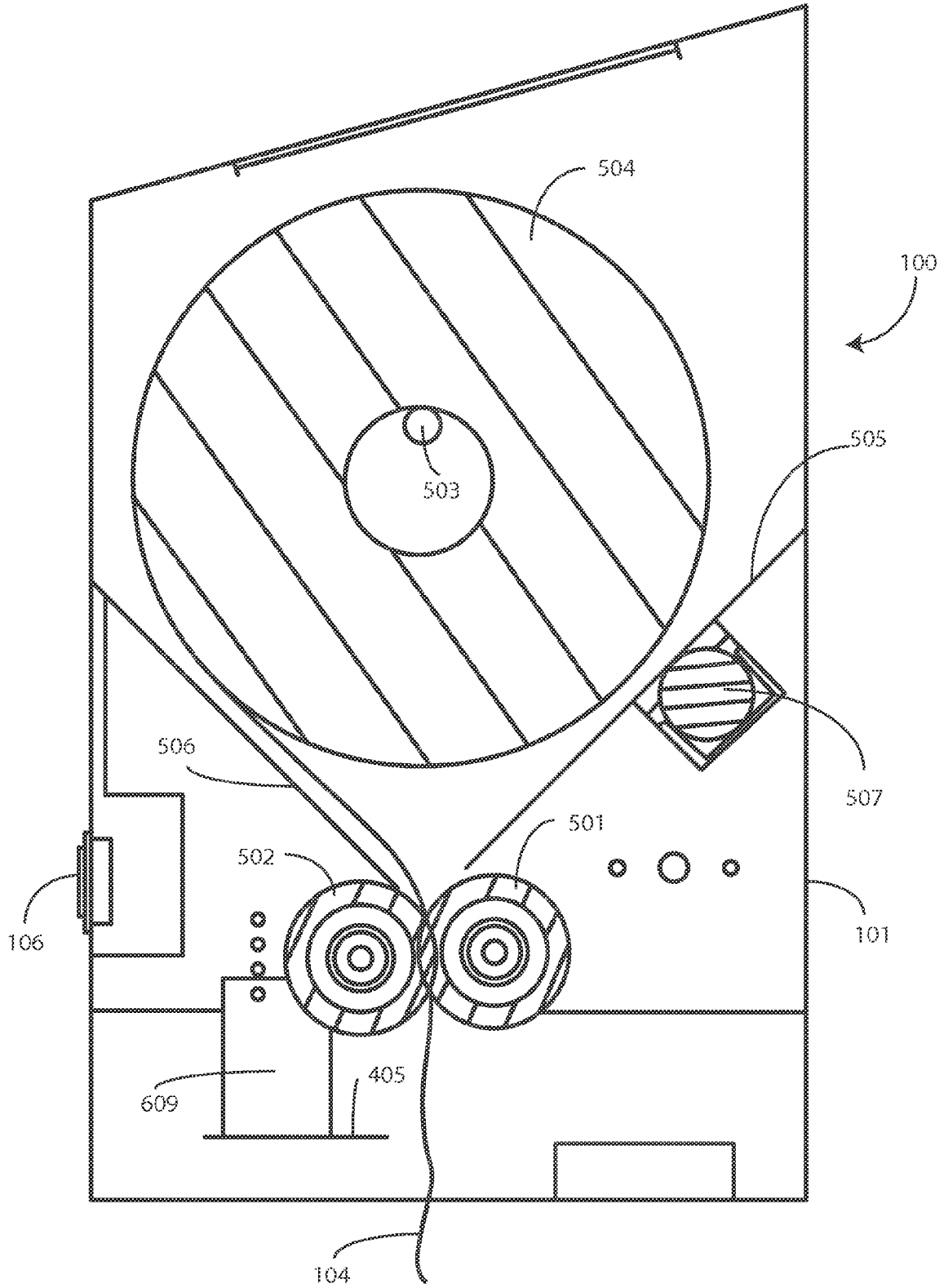
FIG. 5 illustrates a sectional view of one dispenser configured in accordance with one or more embodiments of the invention.

In one embodiment, each of the first housing member 601 and the second housing member 602 includes a rigid inclined plane 505,506 disposed above its respective roller. For instance, as shown in FIG. 5, the first housing member has a first rigid inclined plane 505 disposed above the first feed roller 501, while the second housing member has a second rigid inclined plane 506 disposed above the second feed roller 502. These rigid inclined planes 505,506, where included, perform two functions: First, they help facilitate feeding of the rolled product 104 through the first feed roller 501 and the second feed roller 502. Second, they prevent debris from fouling the feeding system when the rolled sheet dispenser 100 is being serviced.

In one embodiment, to make low-supply detection easier, one of the walls of either the first housing member 601 or the second housing member 602 includes a rolled product capacity detection window 303. In one embodiment, the rolled product capacity detection window 303 comprises an aperture through one sidewall 301. In another embodiment, the rolled product capacity detection window 303 comprises a translucent window, made from glass or plastic. An attendant can quickly determine a remaining capacity 705 of rolled product 104 by looking through the rolled product capacity detection window 303. Note that the capacity detection window 303 could be placed on any of the surfaces of the rolled sheet dispenser 100. For example, it is shown on a sidewall 301 in FIGS. 3 and 7, but could be located on other walls, such as the front wall 102 as indicated by dashed line 660 in FIG. 6. Additionally, multiple rolled product capacity detection windows could be used.

As described above, embodiments of the invention provide a product dispenser that includes a first half housing that is hingedly coupled to a second half housing. A first feed roller is disposed within the first half housing, while a second feed roller is disposed within the second half housing. In one embodiment, each of the first feed roller and the second feed roller are mounted horizontally within the dispenser. When the first half housing is pivoted against the second half housing in a closed position, the first feed roller and the second feed roller abut.

A mounting stem is disposed substantially above an intersection of, and parallel with, the first feed roller and the second feed roller. When the first half housing is pivoted away from the second half housing to an open position, the first feed roller and the second feed roller separate, with an end of the mounting stem becoming exposed and accessible. This separation of rollers and exposure of the mounting stem provides advantages over the prior art in that product loading is greatly simplified. Another advantage is that both cored and coreless rolls, in a variety of dimensions, can be accommodated in a universal dispensing system.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A rolled sheet dispenser, comprising:

a housing comprising a first housing member and a second housing member, the first housing member comprising a mounting wall to mount the rolled sheet dispenser to a wall, wherein the first housing member and the second housing member are coupled together by a hinge assembly arranged substantially parallel with the mounting wall;

a mounting stem, the mounting stem single-ended by an end fixedly coupled to the second housing member and another end open; and a drive roller and a pressure roller, wherein one of the drive roller or the pressure roller is fixedly coupled to the first housing member and another of the drive roller or the pressure roller is fixedly coupled to the second housing member;

wherein the rolled sheet dispenser is configured such that when the second housing member is rotated away from the first housing member about the hinge assembly, the one of the drive roller or the pressure roller separates from the another of the drive roller or the pressure roller and an open end of the single-ended mounting stem is exposed.

2. The rolled sheet dispenser of claim 1, wherein the pressure roller comprises a second drive roller.

3. The rolled sheet dispenser of claim 1, the mounting stem arranged substantially parallel to the another of the drive roller or the pressure roller.

4. The rolled sheet dispenser of claim 3, wherein the second housing member comprises a front wall and a sidewall extending distally from the front wall, wherein the single-ended mounting stem is coupled to the sidewall.

5. The rolled sheet dispenser of claim 3, wherein:

the first housing member has a rigid inclined plane disposed above the one of the drive roller or the pressure roller; and the second housing member has another rigid inclined plane disposed between the single-ended mounting stem and the another of the drive roller or the pressure roller.

6. The rolled sheet dispenser of claim 4, wherein the second housing member comprises a top extending distally from the front wall above the single-ended mounting stem.

7. The rolled sheet dispenser of claim 4, wherein the sidewall defines a rolled paper capacity detection window.

8. The rolled sheet dispenser of claim 7, wherein the front wall and the sidewall are substantially orthogonal.

9. The rolled sheet dispenser of claim 1, wherein the first housing member comprises another sidewall extending distally from the mounting wall.

10. The rolled sheet dispenser of claim 9, wherein the hinge assembly is disposed at an interface between the mounting wall and the sidewall.

11. The rolled sheet dispenser of claim 10, wherein the first housing member comprises a bottom wall extending from the mounting wall and the second housing member has another bottom wall extending from the front wall, wherein the bottom wall and the another bottom wall define a product-dispensing opening.

12. The rolled sheet dispenser of claim 11, further comprising a pivoting cutter head mounted above the product-dispensing opening.

13. The rolled sheet dispenser of claim 12, wherein the pivoting cutter head is coupled to a switch configured to actuate the drive roller when the pivoting cutter head is pivoted.

14. The rolled sheet dispenser of claim 13, further comprising an auxiliary switch configured to override the switch.

15. The rolled sheet dispenser of claim 1, wherein the first housing member and the second housing member are manufactured from metal.

16. The rolled sheet dispenser of claim 1, wherein the housing further comprises a lock disposed opposite the hinge assembly for selectively locking the first housing member and the second housing member together.

17. The rolled sheet dispenser of claim 3, wherein the single-ended mounting stem is configured to accommodate:

either eight inch paper rolls or ten inch paper rolls; and either cored paper rolls or coreless paper rolls.

18. The rolled sheet dispenser of claim 1, wherein the drive roller is battery operated.

19. A paper dispenser, comprising:

a first half housing hingedly coupled to a second half housing by a vertically mounted hinge;

a first feed roller coupled to the first half housing and a second feed roller coupled to the second half housing, wherein the first feed roller and the second feed roller are mounted horizontally within the paper dispenser; and a mounting stem disposed substantially above an intersection of, and parallel with, the first feed roller and the second feed roller, the mounting stem single-ended with an end fixedly coupled to the second half housing and another end open;

wherein when the first half housing is pivoted against the second half housing, the first feed roller and the second feed roller abut; and wherein when the first half housing is pivoted away from the second half housing, the first feed roller and the second feed roller separate, with an open end of the mounting stem becoming exposed and accessible to receive a roll of product slid along the single-ended mounting stem.

* * * * *